US008556268B2

(12) United States Patent
Su

(10) Patent No.: US 8,556,268 B2
(45) Date of Patent: Oct. 15, 2013

(54) AFFIXABLE FIREARMS TARGET CAPABLE OF LEAVING A CUSTOM-SHAPED SILHOUETTE VISIBLE FROM AFAR UPON THE PROJECTILE'S IMPACT ON THE TARGET'S BULLSEYE

(76) Inventor: Wei Su, Elk Grove, CA (US)

( * ) Notice: Subject to any disclaimer, the term of this patent is extended or adjusted under 35 U.S.C. 154(b) by 135 days.

(21) Appl. No.: 13/359,768

(22) Filed: Jan. 27, 2012

(65) Prior Publication Data

US 2013/0193646 A1 Aug. 1, 2013

(51) Int. Cl.
*F41J 5/14* (2006.01)

(52) U.S. Cl.
USPC ..... 273/380; 273/378

(58) Field of Classification Search
USPC ..... 273/378, 379, 380, 383, 387; 283/101, 283/105; 40/630, 638
See application file for complete search history.

(56) References Cited

U.S. PATENT DOCUMENTS

| | | | | | |
|---|---|---|---|---|---|
| 3,285,066 | A | * | 11/1966 | Lage | 73/167 |
| 3,353,827 | A | * | 11/1967 | Dun, Jr. | 273/378 |
| 3,370,852 | A | * | 2/1968 | Kandel | 273/378 |
| 3,431,667 | A | * | 3/1969 | Woods | 40/710 |
| 3,895,803 | A | * | 7/1975 | Loe | 273/378 |
| 3,899,175 | A | * | 8/1975 | Loe | 273/378 |
| 4,462,598 | A | * | 7/1984 | Chalin et al. | 273/378 |
| 4,810,561 | A | * | 3/1989 | King | 428/195.1 |
| 5,181,719 | A | * | 1/1993 | Cleveland, III | 273/409 |
| 5,501,467 | A | * | 3/1996 | Kandel | 273/378 |
| 5,580,063 | A | * | 12/1996 | Edwards | 273/378 |
| 5,647,596 | A | * | 7/1997 | Rail | 273/383 |
| 6,254,138 | B1 | * | 7/2001 | Rawlings et al. | 283/81 |
| 6,385,875 | B1 | * | 5/2002 | Santorsola | 40/124.191 |
| 6,420,008 | B1 | * | 7/2002 | Lewis et al. | 428/78 |
| 6,601,876 | B1 | * | 8/2003 | Instance | 283/81 |
| 6,896,295 | B1 | * | 5/2005 | Casagrande | 283/61 |
| 6,907,683 | B1 | * | 6/2005 | Kronblad | 40/1.5 |
| 7,631,877 | B2 | * | 12/2009 | Zara | 273/378 |
| 2004/0060217 | A1 | * | 4/2004 | Ray et al. | 40/638 |

* cited by examiner

*Primary Examiner* — Mark Graham

(57) ABSTRACT

A "indicating" projectile impact target, or group of such, that can be affixed to the front of an existing thin walled projectile impact target, where the indicating target(s) "actuate", upon being struck by a projectile at one of the indicating target's bullseye locations, to leave a custom silhouette in the indicating target and the existing target, in order to indicate the bulls eye strike to the shooter.

2 Claims, 12 Drawing Sheets

AFFIXABLE FIREARMS TARGET CAPABLE OF LEAVING A CUSTOM-SHAPED SILHOUETTE VISIBLE FROM AFAR UPON THE PROJECTILE'S IMPACT ON THE TARGET'S BULLSEYE

BACKGROUND OF THE INVENTION

1. Field of the Invention

The present invention relates to a firearms projectile target and, more specifically, a smaller bullseye target that is affixable to an existing larger, where the smaller affixable target signifies when it has been struck by the projectile by providing an easily distinguishable custom shaped hole or silhouette in the existing target that can be plainly viewed by the shooter with the naked eye.

2. Description of Related Art

Firearms are used in law enforcement and the military where such use requires accurate shooting by a firearm user or shooter. To aid in achieving accuracy, target ranges are usually used by individuals to train or practice. Typically, target ranges place a supported paper target or other thin-layer target at some distance from the firearm user or shooter for which to shoot at and develop accurate shooting skills thereby doing. The firearm is aimed at markings on the target, and projectiles, such as bullets, are then shot from the firearm to pass through the markings on the target.

Common firearms targets comprise generally a sheet of paper or other thin layer with a target image printed thereon. When punctured by a projectile or bullet, a hole about the size of the diameter of the bullet is produced in the target. Target hole diameters are typically less that one-half inch. A deficiency of the thin wall target is that typically it is very difficult for the shooter to see the bullet holes in the target in order to determine whether he has accurately struck the target or not.

Many firearms such as rifles have effective ranges of 50 yards or more, and thus many target ranges include shooting range distances of 50 yards or more. Thus, the distance from the shooter to the target would be 50 yards or more. At this distance, it is impossible to see a small bullet hole in a thin wall target without the assistance of binoculars, telescope, or similar optical image amplifier.

The use of binoculars, telescope, or similar optical image amplifier to determine whether a target has been hit or not is cumbersome because typically the shooter must put down his weapon, pick up the binoculars, telescope, or similar, visually reacquire the target, and then determine whether he has struck the target or not and if so at exactly which point. Only to then put the binoculars, telescope, or similar down, in order to pick up the weapon again, visually reacquire the target for the third time, aim, and fire, all just to take two shots at the target. Obviously, if the shooter could determine if and where he has struck the target from long range without putting down his weapon, it is less cumbersome and easier to practice target shooting.

To remedy this, "indicating targets" have become available that function in various ways to create larger more visible areas on a target in order to more plainly indicate to the shooter when the projectile strikes a certain area on the target. Indicator targets have done this using various methods as described in U.S. Pat. No. 3,895,803. One of the latest versions of an indicating target is U.S. Pat. Nos. 5,188,371 and 5,580,063, which uses ink in a special way along with a contrasting color plastic sheets to provide said indication.

This invention is an improvement in this vein because the invention is a target, or group of targets, that can be affixed to the front of an existing thin walled target, where the affixed target then actuates to leave a custom silhouette in the affixable target and the existing target upon being struck by a projectile at the affixable target's bullseye.

BRIEF SUMMARY OF THE INVENTION

It is an object of this invention to provide a firearms projectile target that is affixable to the front of an existing firearms projectile target that is supported in some way.

It is an object of this invention to provide a graphics pattern or artwork on the front side of the affixable target that displays a target pattern for the shooter to aim at, with at least one distinguishable bullseye section in the frontside graphics pattern or artwork.

It is an object of the invention for the frontside graphics pattern or artwork to provide a game for the shooter to play with one or more other shooters like billiards, tic-tac-toe, or other. To play the game, shooters aim at one or more of the at least one distinguishable bullseye sections, and upon striking a bullseye section, the shooter would "sink" that particular ball with the billiards game, for instance, or earn an "X" or an "O" in the tic-tac-toe game, for instance. The particular game played would be determined by the frontside graphics pattern or artwork and is not material to the invention. This invention could include any frontside graphics pattern or artwork to play any game as long as the frontside graphics pattern or artwork included at least one distinguishable bullseye pattern, which is used to help actuate the invention or to cause the custom silhouette to appear, as discussed below.

It is an object of the invention for all distinguishable bullseye sections of the graphics pattern or artwork to comprise a bullet proof layer.

It is an object of the invention to include a main layer with a perforation pattern on it, where the perforation pattern is a special shape that is the outline that makes the custom silhouette of the invention. Further, the perforation pattern has an interior and exterior of the perforation pattern.

It is an object of this invention to "actuate" when a bullet or projectile strikes the bullseye section, thereby causing the blow-back of the bullet proof layer, thereby causing the perforation pattern to separate from the main layer, pulling with it debris from the existing target, leaving a custom shaped silhouette in the main layer that is clearly visible to the shooter from afar.

DEFINITION LIST

| Term | Definition |
|---|---|
| 10 | Affixable Target |
| 20 | Bullseye Layer (Bullet Resistant Layer) |
| 30 | Target Pattern Wadding Layer |
| 40 | Main Layer |
| 42 | Interior Portion of Perforation Pattern |
| 45 | Perforation Pattern (Custom Silhouette Shape) |
| 47 | Exterior Portion of Perforation Pattern |
| 60 | Affixation or Adhesive Layer |
| 65 | Optional Affixation or Adhesive Layer |
| 80 | Bullet or Projectile |

DETAILED DESCRIPTION OF THE INVENTION

Affixable target comprises a main layer 40 with a front side and back side. Main layer 40 is a thin layer of semirigid paper, film, fabric, or other thin-walled semirigid sheet material with measure of Taber stiffness of about 3-65 mNm. (Taber stiffness is a measure of flexural rigidity and is the measure of the bending moment in mNm required to deflect the free end of a 1.5 inch wide vertically clamped specimen 15 degrees from its center line when the load is applied 10 mm away from the clamp.) Main layer 40 typically has a special shape such as a circle, square, rectangle, triangle, or any other geometric shape, but also could be a custom shape such as a deer, or other hunting prey, a tank, or other military item, or any shape to represent a distinguishable item to the shooter.

Figure 1:
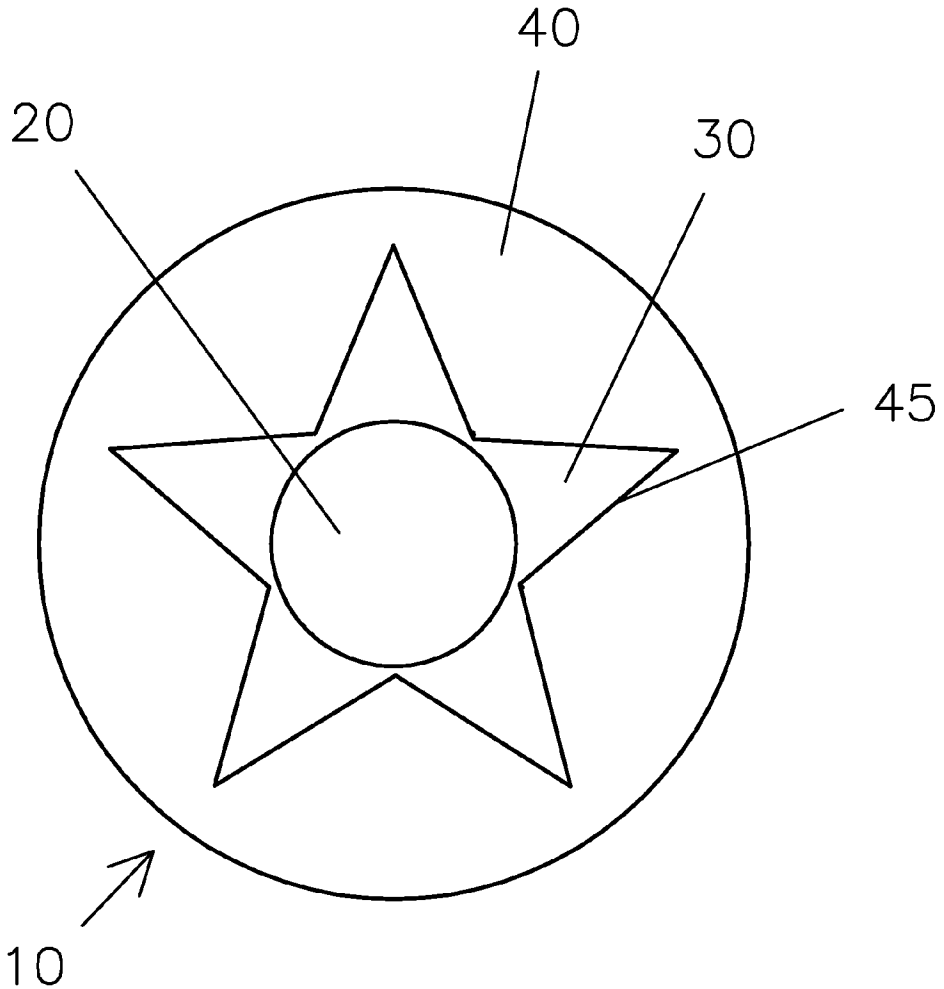
FIG. 1 is a front elevation view of a mode of the invention with a star graphics target pattern and star-patterned custom silhouette.
Figure 2:
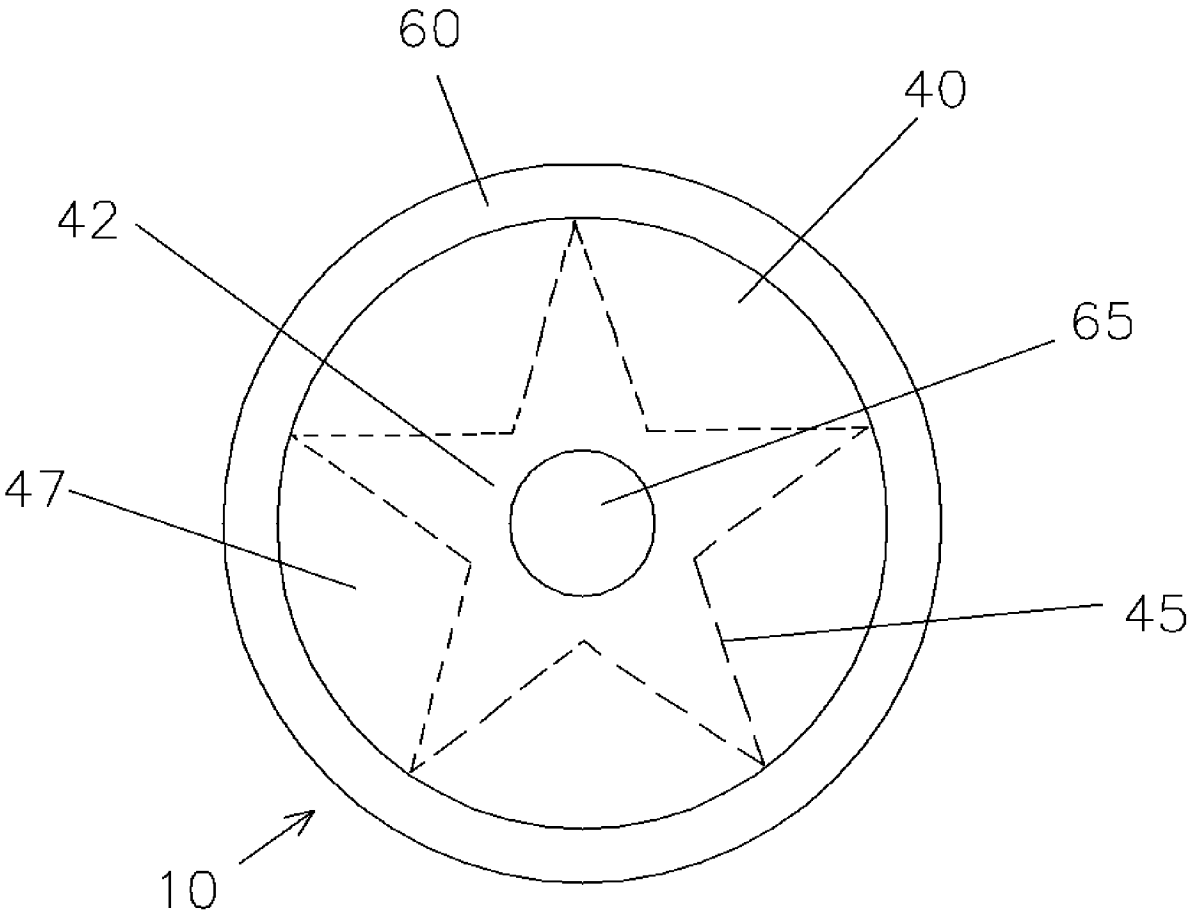
FIG. 2 is a rear elevation view of a mode of the invention with a star graphics target pattern and star-patterned custom silhouette.
Figure 3:
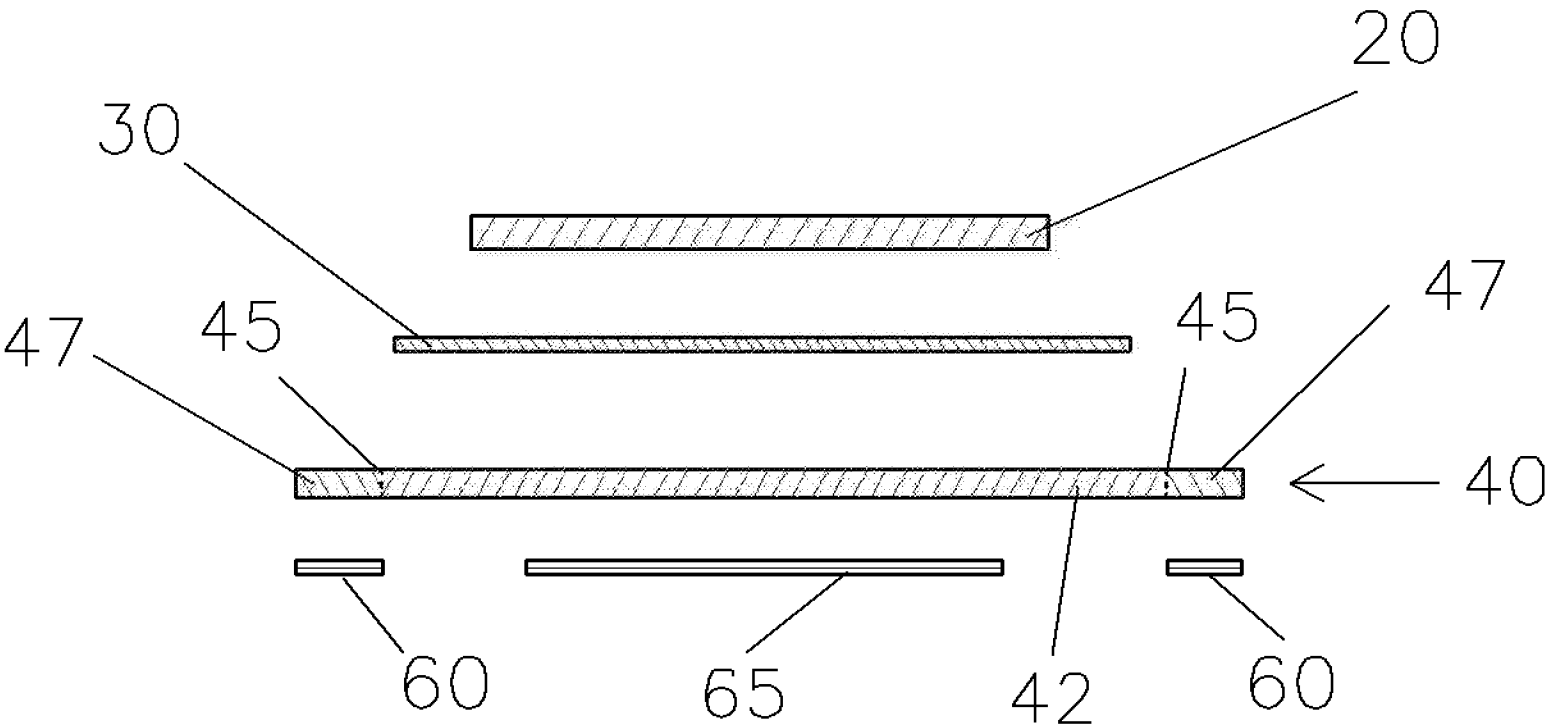
FIG. 3 is a cross sectional exploded view of the invention at the bisect.
Figure 4:
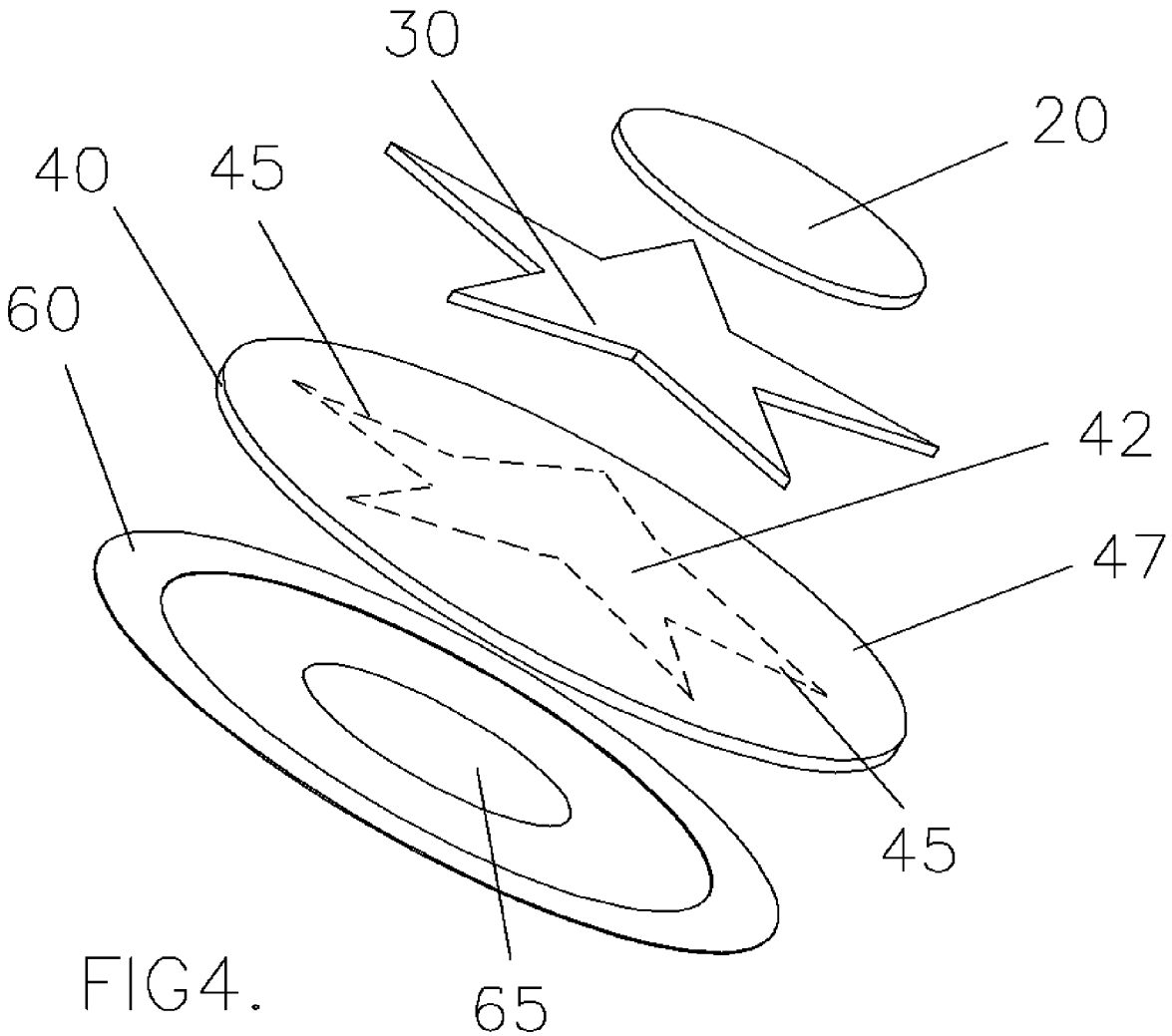
FIG. 4 is a perspective exploded view of a mode of the invention with a star graphics target pattern and star-patterned custom silhouette.
Figure 5:
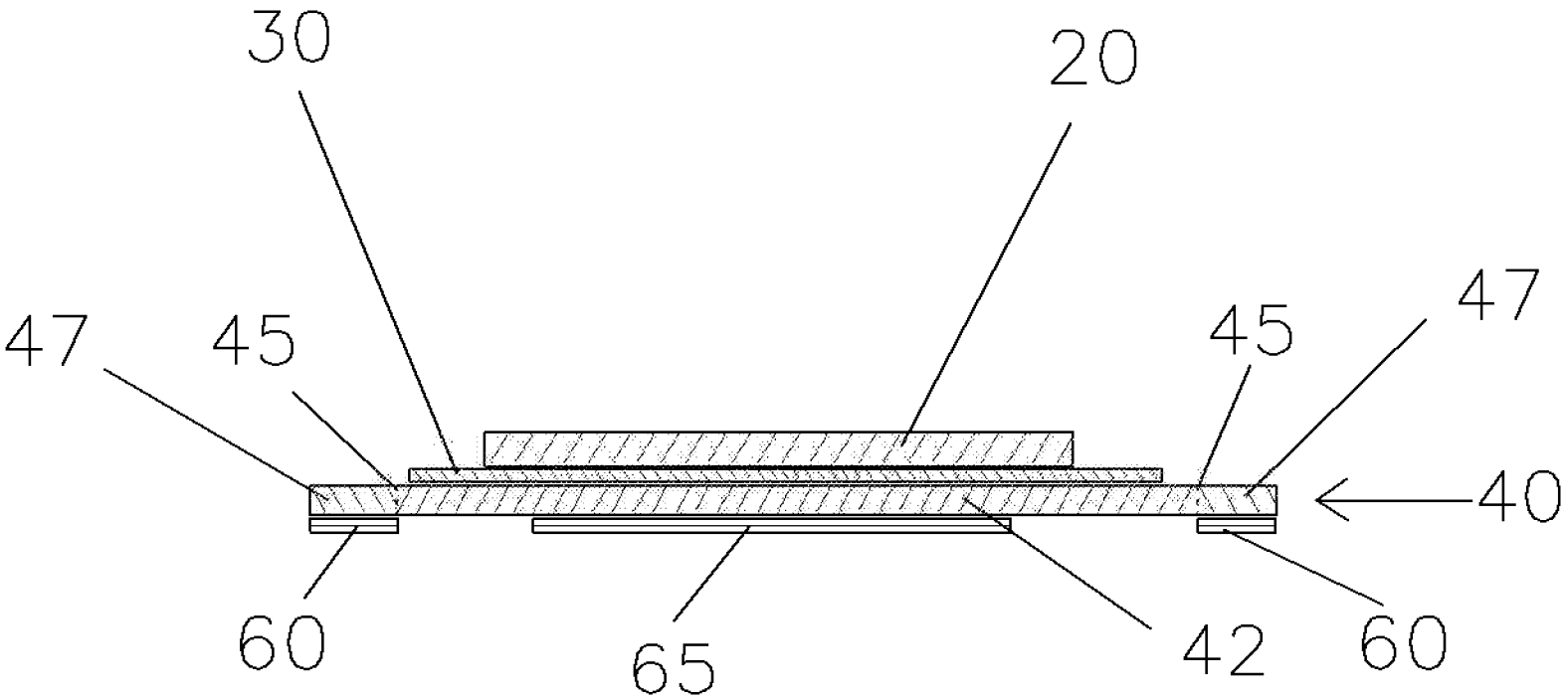
FIG. 5 is a cross sectional view of the invention at the bisect.
Figure 6:
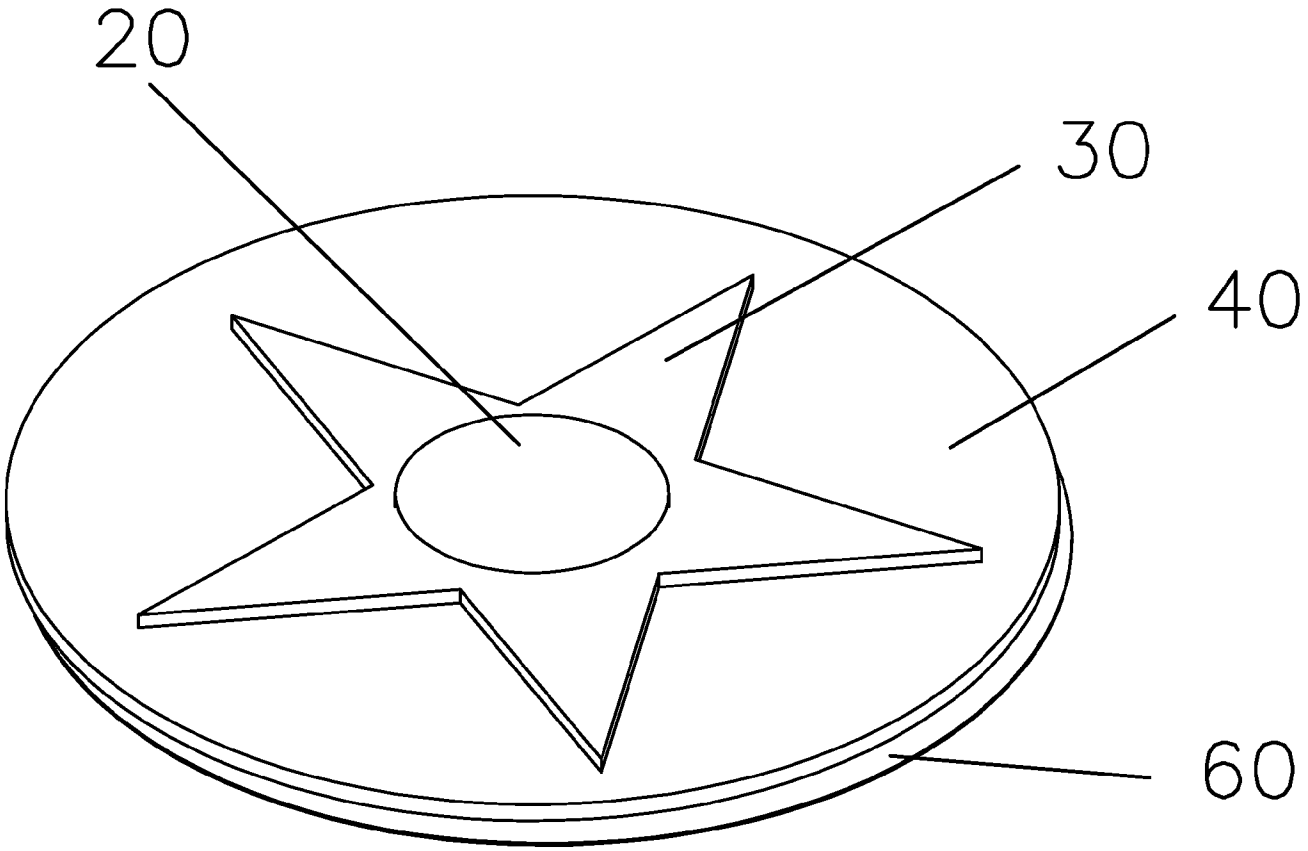
FIG. 6 is a perspective view a mode of the invention with a star graphics target pattern and star-patterned custom silhouette.
Figure 7:
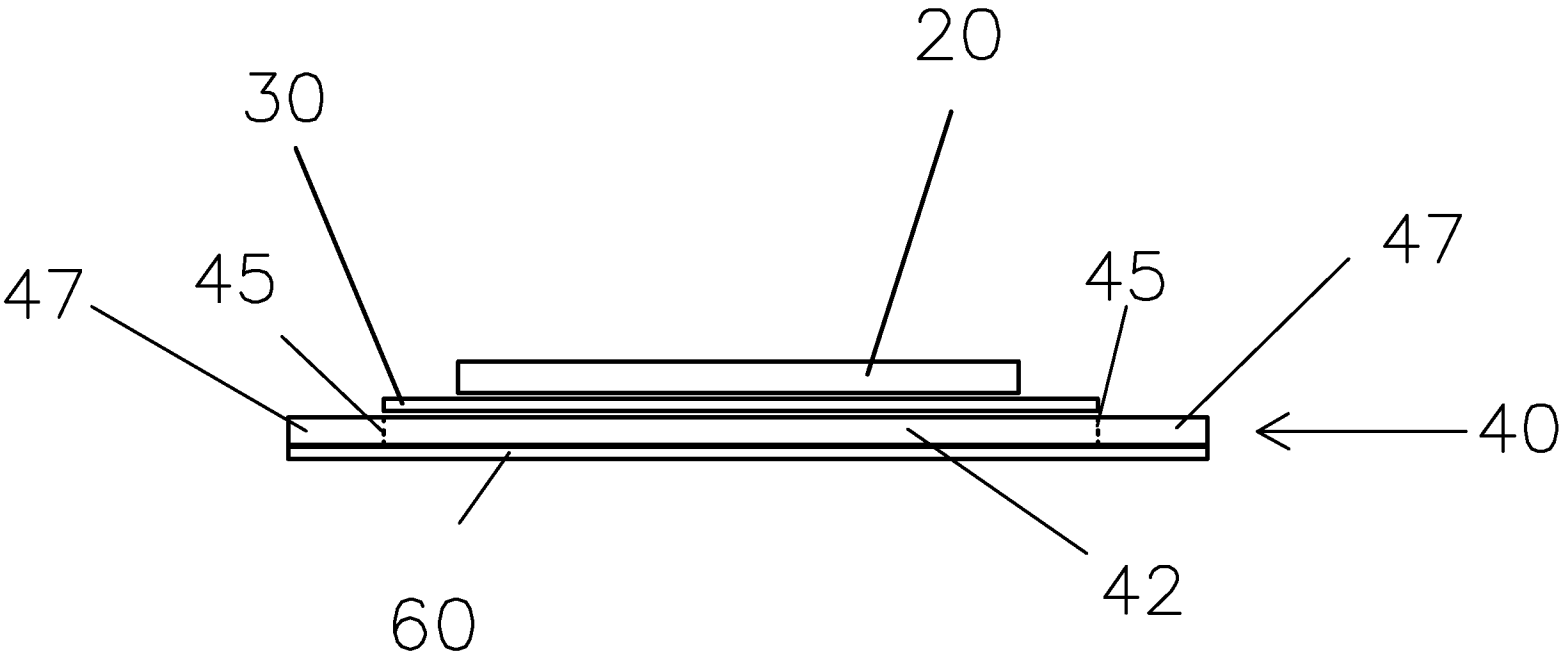
FIG. 7 is a side elevation view of the invention.

On the back side of main layer 40, there is affixation or adhesive layer 60, and optionally, another affixation or adhesive layer 65. Affixation or adhesive layer 60 lies "outside" of perforation pattern 45 as seen in FIG. 2. Affixation or adhesive layer 65 lies "inside" of perforation pattern 45 as seen in FIG. 2. Affixation or adhesive layers 60, 65 are layers of adhesive, glue, or other bonding agent that function to adhere the affixable target to the existing target (not depicted). Typically, affixation or adhesive layers 60, 65 are pressure sensitive adhesive but could be any bonding agent available on the market that functions to adhere layer 40 to the particular material that happens to make up the existing target of interest. The particular bonding agent used is not material to this invention.

Affixable target further comprises a target pattern wadding layer 30 with a front side and a back side, that is affixed or adhered to the front side of main layer 40. Target pattern wadding layer 30 displays some sort of recognizable frontside graphics pattern or artwork and may have an overall shape that is distinguishable to the shooter from afar. In FIGS. 1-7 of this patent application, we use a "star" pattern and a "star" overall shape as an example of such of a particular target pattern and shape of a target pattern wadding layer 30. However, target pattern wadding layer 30 could take any frontside graphics pattern, artwork, shape, or other geometric shape and pattern combination, such as a deer, or other hunting prey, a tank, or other military item, or any shape to represent a distinguishable item to the shooter. The particular graphical display and shape of target pattern wadding layer 30 is not material to the invention.

Target pattern wadding layer 30 is made from rigid to semirigid material such as cardboard, card stock, poster board, wood board, or other rigid to semirigid material with measure of Taber stiffness of about 8-100 mNm. Typically, target pattern wadding layer 30 must be slightly stiffer than the main layer 40 for actuation to cycle properly as discussed below.

Target pattern wadding layer 30 is not bullet resistant or projectile resistant. Thus, if a bullet or projectile 80 strikes target pattern wadding layer 30, the bullet or projectile 80 passes right through layer 30, to leave a small hole in target pattern wadding layer 30.

Main layer 40 includes a perforation pattern 45. Perforation pattern 45 is the silhouette pattern or special shape that is visible from afar, after the target has been actuated. Perforation pattern 45 is a series of many small perforations or holes that go all the way through main layer 40, arranged end-to-end, to form a closed-perimeter pattern or outline, that is the custom silhouette shape of the invention. The inside area of perforation pattern 45 is designated as interior portion 42. The outside area of perforation pattern 45 is designated as exterior portion 47.

Typically, target pattern wadding layer 30 is slightly smaller than or the same size as perforation pattern 45. The back side of target pattern wadding layer 30 is permanently affixed or adhered to the front side of main layer 40. Target pattern wadding layer 30 is positioned in alignment in front of perforation pattern 45.

Affixable target further comprises a bullseye layer 20 permanently affixed or adhered to the front side of target pattern wadding layer 30. Bullseye layer 20 is made of bullet resistant or projectile resistant material such as metal, kevlar, ceramic, or other material available on the market that is thin and bullet resistant. Bullseye layer 20 has thickness of about 0.004-0.250 inches. Bullseye layer 20 is the front most layer of affixable target 10. Typically, bullseye layer 20 has a smaller overall diameter than that of target pattern wadding layer 30. Typically, bullseye layer 20 is in the shape of a circle but can be of any shape. However, the particular shape of bullseye layer 20 is immaterial to the invention. Typically, the shape of bullseye layer 20 must fit in artistically with the overall frontside graphics pattern or artwork and shape of of target pattern wadding layer 30.

With reference to FIGS. 1-7 and 11-12, the following shapes were used for exemplary purposes only, in order to help describe the invention and how the target actuates upon proper impact by the projectile 80 upon bullseye 20 causing actuation, resulting in the custom silhouette visible from afar. In the example, main layer 40 has the shape of a large circle. Perforation pattern 45 has the shape of a star. Target pattern wadding layer 30 has the graphics pattern of a star and the shape of a star. Perforation pattern 45 and target pattern wadding layer 30 are the same size and shaped star. Bullseye layer 20 has the shape of a smaller circle.

Figure 11:
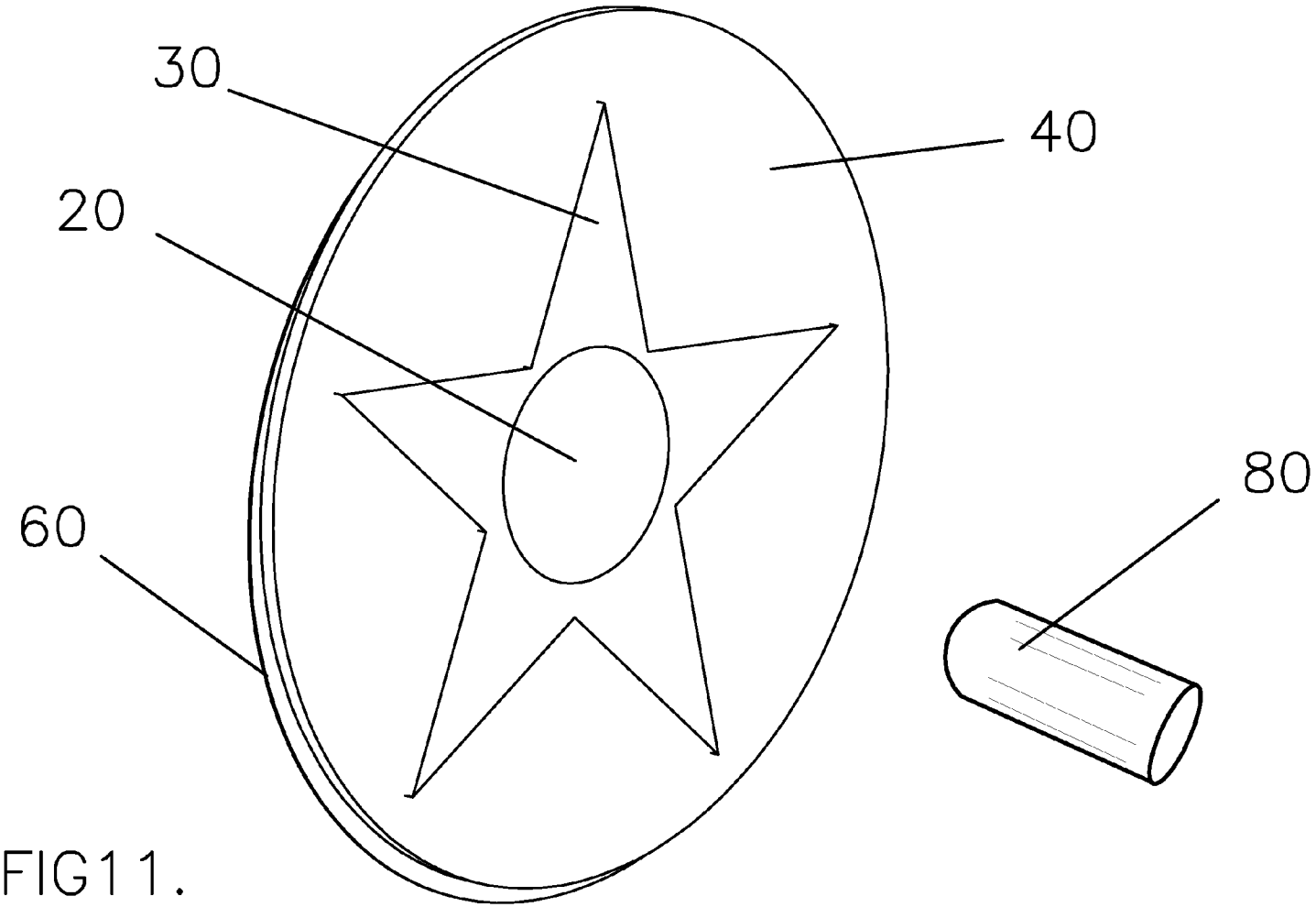
FIG. 11 is a perspective view of a mode of the invention with a star graphics target pattern and star patterned custom silhouette, just prior to actuation.
Figure 12:
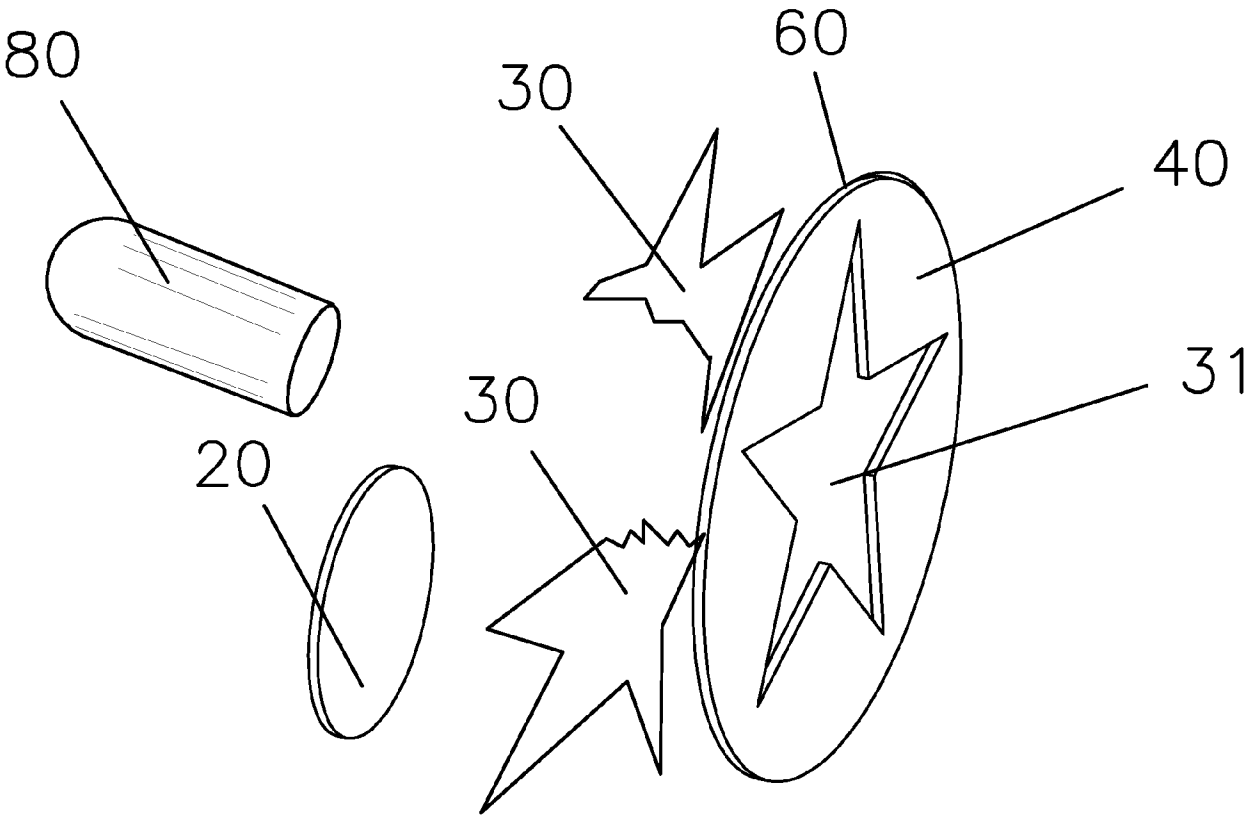
FIG. 12 is a perspective view of a mode of the invention with a star graphics target pattern and star patterned custom silhouette, just after actuation.

With reference to FIGS. 11 and 12, we can understand how the affixable target actuates. In FIG. 11, the projectile or bullet 80 is depicted just before impacting the bullseye layer 20. Upon impact, because of its bullet resistant nature, layer 20 is pushed backward (in the direction of travel of the projectile), knocked backward, or "blown back", by projectile 80.

Blow-back is depicted in FIG. 12. Bullseye layer 20 pushes back target pattern wadding layer 30, to cause all perforations in perforation pattern 45 to give way, causing the interior of the perforation pattern 42 to become completely separated from the exterior of the perforation pattern 47. This occurs because of the force of the bullet on the bullseye layer, which in turn pushes on the wading layer, which is of a sufficiently rigidity to stand up to the forces of the blow back, and overcome the forces of the perforations, in order to tear completely and cleanly away from the exterior of perforation pattern 47.

The resulting motion of 20, 30, and 42, after the projectile's impact, causes a larger impact onto the existing target (not depicted). The larger impact results from the larger size and mass of the assembly of invention items 20, 30, 42, along with the projectile 80, pushing back with nearly the full force of the bullet's velocity. This motion clears out a large hole in the existing target, so that this hole is larger than that of the perforation pattern 45, thereby leaving a clean and easily visualized custom silhouette pattern 45.

Thus, actuation of the affixable target is completed. With the removal of layers 20, 30, and 42, all that is left is the exterior of the perforation pattern 47, with the interior of the perforation pattern cleanly removed by the projectile's motion. The result is a clear depiction to the shooter from afar of the custom silhouette pattern 45.

It should be noted that for maximum visibility if the custom silhouette shape 45, there should be high between the color of main layer 40 and the background of the shooting range target area. Thus, if light colored gravel is behind the targets, then a particular mode of affixable target 10 with a dark colored main layer 40 should be used. Conversely, if dark colored trees are behind the targets, then a particular mode of affixable target 10 with a light colored main layer 40 should be used.

In order to effect the clean removal of the perforation pattern, there can be no adhesive or bonding agent of the affixation or adhesive layers 60, 65 on the perforation pattern 45. Put another way, no portion of layer 60 or 65 may lie on perforation pattern 45 because perforation pattern 45 must be free to allow clean tearing during push-back or blow-back. Adhesive or bonding agent on the back side of main layer 40 at perforation pattern 45 would interfere with this blow-back and possibly cause unclean breakage in the perforation pattern 45. Thus, all adhesive 60 must lie on the exterior of perforation pattern 45 and all adhesive 65 must lie on the interior of perforation pattern 45.

Affixation or adhesive layer 60 is required to hold layer 40 to the existing target during and after actuation. In order to properly produce the custom silhouette 45, section 47 must remain strongly adhered to the existing target during and after actuation. Thus, the adhesion forces of layer 60 must be strong enough to overcome the adhesion forces in perforations 45.

If the existing target is made of a thicker material, such as cardboard, paperboard, or card stock, or other, an internal affixation or adhesive layer 65 is recommended to help clear away the existing target from behind the silhouette opening 45 during actuation. The interior affixation or adhesive layer 65 affixes the interior portion of the perforation patter 42 to the existing target (not shown). Because layers 20 and 30 are also affixed to main layer 40, affixation layer 65 holds the wadding layer 30 and bullseye layer 20 to the existing target to during blow-back, thereby assisting with the removal of the existing target from behind the custom silhouette area 45. This assistance is effected by the bullseye layer 20 and wadding layer 30 being pushed backward with nearly the full force of the projectile 80. If the existing target is adhered to this combination, then it is more likely to be blown-back with layers 20 and 30, thereby helping clear the area of silhouette 45. Thus, there is a mode of affixable target 10 with internal affixation or adhesive layer 65.

For the graphical design purposes of the target image or other purpose, when the overall diameter of the bullseye layer 20 needs to be larger than that of the perforation pattern 45, then the target pattern wadding layer 30 may be eliminated all together.

In this mode, the bullseye layer 20 is adhered to or affixed to the front side of main layer 40. Importantly, since the overall diameter of bullseye layer 20 is increased slightly, the bullseye layer 20 pulls with it the entire interior of perforation pattern 42 during blow-back, to leave a clear depiction to the shooter from afar of custom silhouette pattern 45.

In this mode, special care must be taken with the affixation or adhesion of bullseye layer 20 to the front side of main layer 40. Adhesive or bonding agent (not depicted) used to permanently adhere these members must be placed only within the interior of perforation pattern 42. Adhesive or bonding agent on the exterior of perforation pattern 47 would interfere with this blow-back and likely cause unclean breakage in the perforation pattern 45. This requirement is different from the requirements of adhesive layers 60, 65 (on the back side of main layer 40) detailed above.

Figure 8:
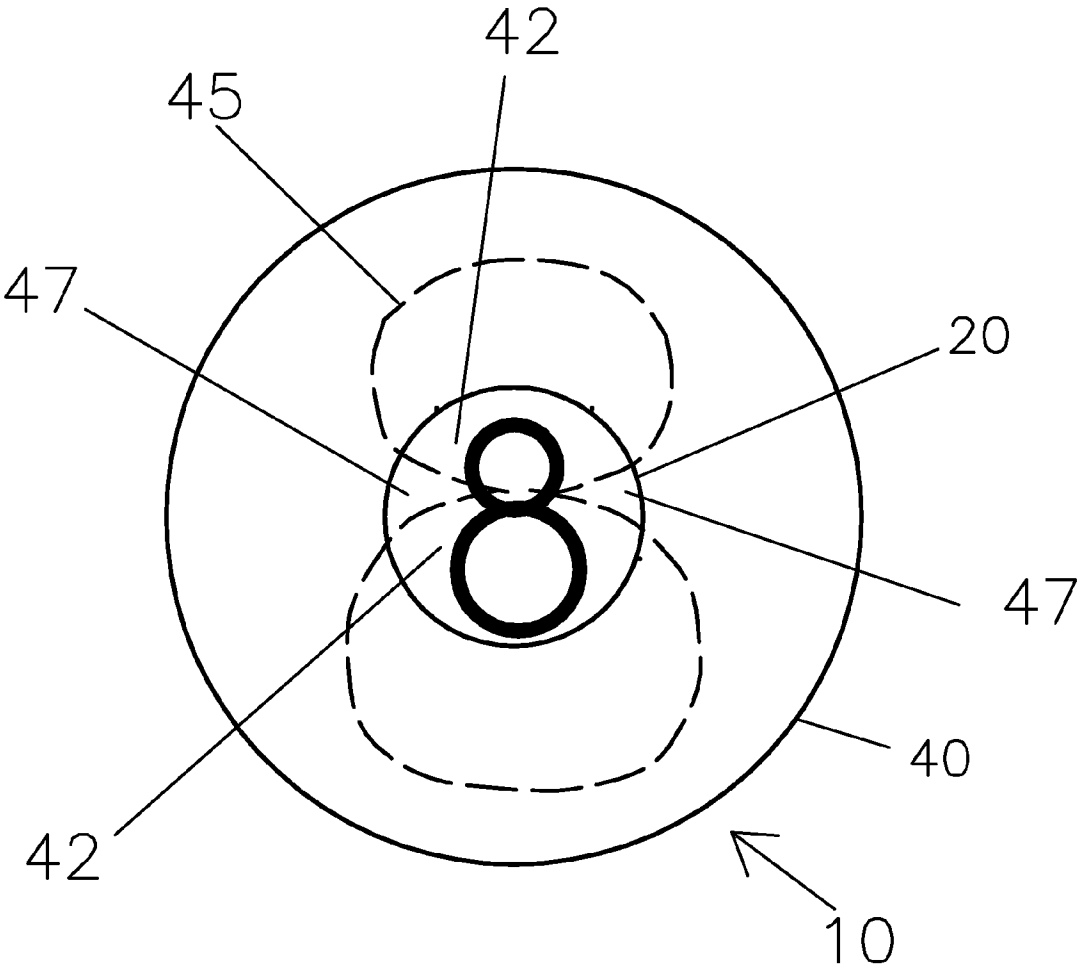
FIG. 8 is a font elevation view of a mode of the invention with an 8-ball graphics target pattern and "8-shaped" custom silhouette.

Referencing FIG. 8, we have this situation, where there is an affixable target 10 with a bullseye layer 20 that is wider than the perforation pattern 45, which is an "8". In other words, at the mid-section of the "8" perforation pattern, we see that the bullseye circle 20 extends wider than the perforation pattern at the two areas marked as 47 in the figure. In order to have proper actuation, there can be no adhesive or bonding agent on the front side of main layer 40 in the two exterior areas 47. In other words, all adhesive or bonding agent on the front side of layer 40 must be placed on area 42, or more technically, at the "intersection" of layer 20 and area 42.

Figure 9:
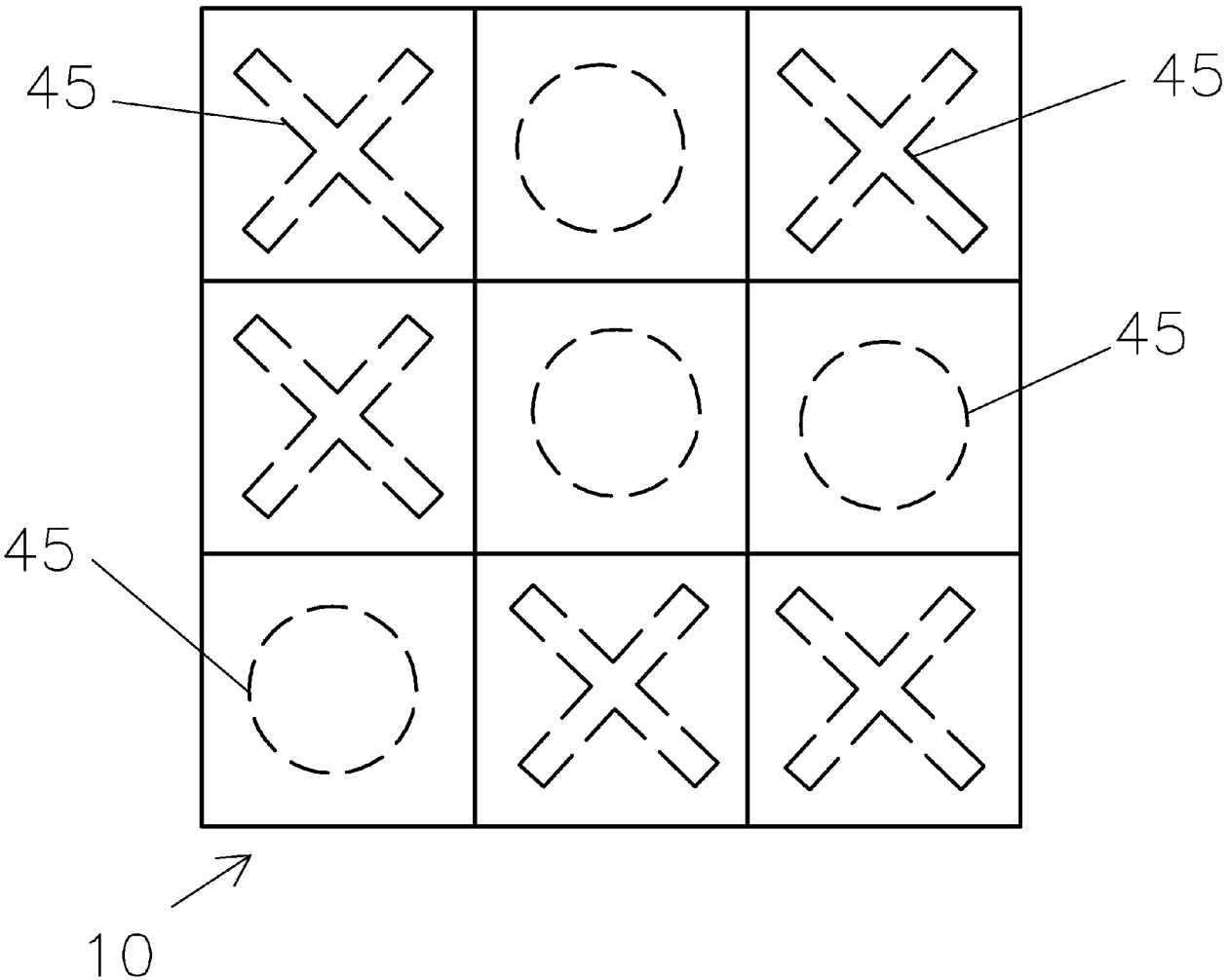
FIG. 9 is a front elevation view of a mode of the invention with a tic-tac-toe graphics target pattern and multiple X-patterned and O-patterned custom silhouettes, depicting the invention after the actuation of nine bullseye sections.

FIG. 9 depicts a mode of the invention with a tic-tac-toe game graphics pattern or artwork. FIG. 9 depicts nine custom silhouettes 45 visible from afar, after actuation of all targets, where the shooters have actuated either the "X" or "O" affixable target bullseye on all nine segments of this mode. Each of the nine segments has two bullseye sections, each with either an "X" or "O" target pattern or artwork on it, for a total of 18 bullseye sections 20 for each affixable target 10 in this mode. Each of the nine segments has one perforation pattern 45, for a total of nine perforation patterns 45 for each affixable target 10 in this mode.

Figure 10:
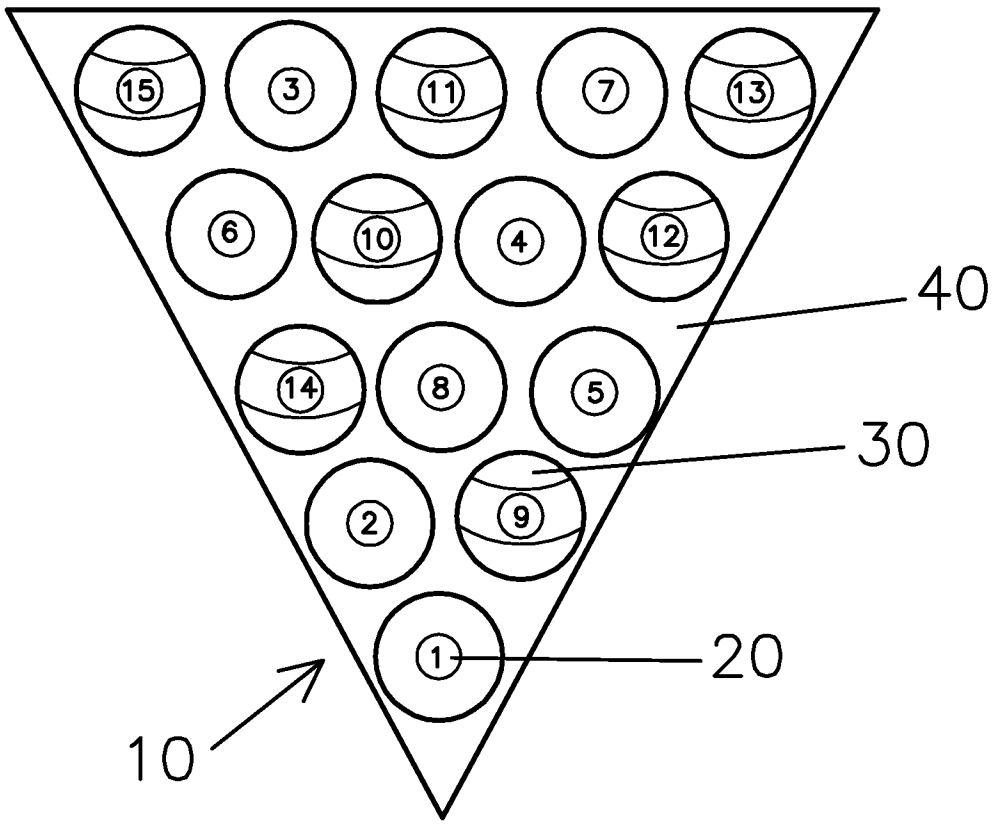
FIG. 10 is a front elevation view of a mode of the invention with a billiards game target pattern, depicting the invention prior to the actuation of any bullseye sections.

FIG. 10 depicts a mode of the invention with a billiards game graphics pattern or artwork. FIG. 10 depicts affixable target 10 without the actuation of any of the 15 bullseye layers 20. FIG. 10 depicts a mode of affixable target 10 with 15 bullseye layers 20, each with a circular shape and a number as the graphics pattern or artwork. FIG. 10 depicts an affixable target 10 with 15 target pattern wadding layers 30, each with circular shape and graphics pattern or artwork depicting a billiards ball.

What is claimed:

1. A projectile impact target that is attachable or affixable to an existing projectile impact target, said projectile impact target comprising:

a main layer, with a front side, a back side, and at least one perforation pattern that is a series of perforations or holes through said main layer, positioned next to each other, in series, to form a closed-perimetered outline that is a silhouette shape distinguishable to the shooter;

at least one target pattern wadding layer, with a front and back side, wherein said at least one target pattern wadding layer is made of semirigid non-bullet resistant material and has an overall diameter less than that of said main layer;

at least one bullseye layer, wherein said at least one bullseye layer is made of rigid bullet resistant material and has an overall diameter less than that of said at least one target pattern wadding layer; and an adhesive layer; wherein, said adhesive layer is applied to said back side of said main layer at any location except the portion of which where said at least one perforation pattern is located, said adhesive layer functions to adhere or affix said affixable target to an existing target that is not part of said affixable target, said at least one target pattern wadding layer is permanently affixed to said main layer, where said back side of said at least one target pattern wadding layer is adhered to or affixed to said front side of said main layer, with said at least one target pattern wadding layer located entirely within the interior of said at least one perforation pattern on said main layer, said front side of said at least one target pattern wadding layer has a graphics pattern, artwork, or overall shape that is distinguishable to the shooter, said at least one bullseye layer is permanently affixed to said at least one target pattern wadding layer, where said at least one bullseye layer is adhered to or affixed to said front side of said at least one target pattern wadding layer, with said at least one bullseye layer located entirely within the interior of said at least one target pattern wading layer, and said at least one bullseye layer has a graphics pattern, artwork, or overall shape that is distinguishable to the shooter.

2. A projectile impact target that is attachable or affixable to an existing projectile impact target, said projectile impact target comprising:

a main layer, with a front side, a back side, and at least one perforation pattern that is a series of perforations or holes through said main layer, positioned next to each other, in series, to form a closed-perimetered outline that is a silhouette shape distinguishable to the shooter;

at least one bullseye layer, wherein said at least one bullseye layer is made of rigid bullet resistant material and has an overall diameter less than that of said at least one perforation pattern; and an adhesive layer; wherein, said adhesive layer is applied to said back side of said main layer at any location except the portion of which where said at least one perforation pattern is located, said adhesive layer functions to adhere or affix said affixable target to an existing target that is not part of said affixable target, said at least one bullseye layer is permanently affixed to said main layer, where said at least one bullseye layer is adhered to or affixed to said front side of said main layer, with said at least one bullseye layer located entirely within the interior of said at least one perforation pattern, and said at least one bullseye layer has a graphics pattern, artwork, or overall shape that is distinguishable to the shooter.

* * * * *